US010516945B2

(12) United States Patent
Kim et al.

(10) Patent No.: US 10,516,945 B2
(45) Date of Patent: Dec. 24, 2019

(54) HIGH POWER MICROSPEAKER WITH SUB-DIAPHRAGM

(71) Applicant: EM-TECH. Co., Ltd., Busan (KR)

(72) Inventors: Cheon Myeong Kim, Gyeongsangnam-do (KR); Ji Hoon Kim, Gyeongsangnam-do (KR); Sung Chul Jung, Gyeongsangnam-do (KR); Seul Ki Nam, Gyeongsangnam-do (KR)

(73) Assignee: EM-TECH Co., Ltd., Busan (KR)

( * ) Notice: Subject to any disclaimer, the term of this patent is extended or adjusted under 35 U.S.C. 154(b) by 0 days.

(21) Appl. No.: 15/976,198

(22) Filed: May 10, 2018

(65) Prior Publication Data

US 2018/0332397 A1 Nov. 15, 2018

(30) Foreign Application Priority Data

May 11, 2017 (KR) ..... 10-2017-0058630
May 29, 2017 (KR) ..... 10-2017-0066092
Jun. 28, 2017 (KR) ..... 10-2017-0081703

(51) Int. Cl.

| | |
|---|---|
| ***H04R 7/12*** | (2006.01) |
| ***H04R 7/04*** | (2006.01) |
| ***H04R 9/04*** | (2006.01) |
| ***H04R 9/06*** | (2006.01) |
| ***H04R 9/02*** | (2006.01) |

(52) U.S. Cl.

CPC ..... *H04R 7/127* (2013.01); *H04R 7/04* (2013.01); *H04R 9/025* (2013.01); *H04R 9/045* (2013.01); *H04R 9/06* (2013.01)

(58) Field of Classification Search

CPC ..... H04R 7/122; H04R 7/16; H04R 9/043; H04R 9/045; H04R 9/06; H04R 1/00; H04R 2499/11; H04R 31/003; H04R 31/006; H04R 9/025; H04R 9/04; H04R 7/127; H04R 7/04; G10K 13/00

USPC ..... 381/335, 342, 345, 184, 398, 412, 162, 381/185, 386, 400, 430, 403, 404, 423, 381/424; 181/173

See application file for complete search history.

(56) References Cited

U.S. PATENT DOCUMENTS

| | | | | |
|---|---|---|---|---|
| 4,817,165 A * | 3/1989 | Amalaha | ..... | H04R 7/122 181/170 |
| 9,210,511 B2 | 12/2015 | Yi | | |
| 2002/0071592 A1 * | 6/2002 | Proni | ..... | H04R 9/06 381/423 |
| 2010/0290660 A1 * | 11/2010 | Fukuda | ..... | H04R 7/122 381/355 |

(Continued)

FOREIGN PATENT DOCUMENTS

| | | |
|---|---|---|
| KR | 20110022203 A | 3/2011 |
| KR | 101495523 B1 | 2/2015 |
| KR | 101626865 B1 | 6/2016 |

*Primary Examiner* — Norman Yu

(74) *Attorney, Agent, or Firm* — Murphy, Bilak & Homiller, PLLC

(57) ABSTRACT

The present invention relates to a high power microspeaker having a separate sub-diaphragm on a top end surface of a coil, in addition to a diaphragm and a suspension. The present invention provides a structure in which an acoustic system including a main diaphragm and a conductive suspension of a microspeaker is attached to a top end surface of a coil and a separate sub-diaphragm is attached to the same surface of the coil.

14 Claims, 17 Drawing Sheets

(56) References Cited

U.S. PATENT DOCUMENTS

| | | | | |
|---|---|---|---|---|
| 2013/0133975 | A1* | 5/2013 | Kim | H04R 7/16<br>181/166 |
| 2014/0140543 | A1* | 5/2014 | Yi | H04R 7/20<br>381/162 |
| 2014/0241566 | A1* | 8/2014 | Choi | H04R 9/04<br>381/400 |

* cited by examiner

HIGH POWER MICROSPEAKER WITH SUB-DIAPHRAGM

TECHNICAL FIELD

The present invention relates to a high power microspeaker having a separate sub-diaphragm on a top end surface of a coil, in addition to a diaphragm and a suspension.

BACKGROUND

In general, a microspeaker includes a magnetic circuit, a coil vibrating due to a mutual electromagnetic force with the magnetic circuit, and a diaphragm to which the coil is attached, the diaphragm vibrating with vibration of the coil and emitting sound.

In vibration of the coil, the diaphragm does not always vibrate in a desired direction, i.e., in a direction perpendicular to the diaphragm, but biased vibration or split vibration occurs, which leads to sound distortion. Thus, a suspension or the like is further provided between the diaphragm and the coil to solve the foregoing problem.

However, as high power is required for the microspeaker, there is an increase in factors causing biased vibration or split vibration, such as the increase in the overall height of the coil, the increase in amplitude, or the like. Therefore, additional structural changes are required to prevent the biased vibration or split vibration, FIG. 1 is a view showing a conventional microspeaker which further includes an edge part at a lower portion of a suspension. A microspeaker disclosed in U.S. Pat. No. 9,210,511 includes a lower edge part (sub-side diaphragm) at a lower portion of a suspension, in addition to a dome part (center diaphragm), an upper edge part (side diaphragm) and the suspension, to prevent sound distortion.

However, the lower edge part is integrally formed in a ring shape, like the upper edge part, and the upper edge part and the lower edge part are coupled to form an air pocket. This air pocket raises heat in the diaphragm, which is disadvantageous for the high-power speaker, and increases the rigidity of the whole acoustic system, which leads to reduction of a sound pressure level (SPL). In addition, the air inflow is not smooth between the upper edge part and the lower edge part, which causes deformation of the diaphragm in vibration.

SUMMARY

An object of the present invention is to provide a high power microspeaker with a sub-diaphragm which can be provided with the split-type sub-diaphragm to facilitate the air inflow between a main diaphragm and the sub-diaphragm.

Another object of the present invention is to provide a high power microspeaker with a sub-diaphragm which can compensate for differences in diaphragm rigidity between the long sides and the short sides of the rectangular microspeaker structure to improve vibration balance.

According to an aspect of the present invention for achieving the above objects, there is provided a high power microspeaker with a sub-diaphragm, comprising: a frame; a magnetic circuit installed in the frame; a voice coil having a bottom end positioned in a magnetic gap of the magnetic circuit; an acoustic system including a main diaphragm vibrated by the voice coil to emit sound and a conductive suspension for guiding vibration of the main diaphragm and transferring an electric signal to the voice coil; and the sub-diaphragm attached to the bottom surface of the acoustic system to guide vibration of the main diaphragm.

In some embodiments, the sub-diaphragm is formed in a dome shape with a protruding center portion.

In some embodiments, the sub-diaphragm is formed in a flat shape without a protruding portion.

In some embodiments, the sub-diaphragm is attached to the outside of the attachment position of the voice coil.

In some embodiments, the sub-diaphragm is attached to the bottom surface of the acoustic system, and the voice coil is attached to the bottom surface of the sub-diaphragm.

In some embodiments, the conductive suspension includes an outer peripheral part seated on the frame, an inner peripheral part spaced apart from the outer peripheral part, with the voice coil attached thereto, and a bridge for connecting the outer peripheral part to the inner peripheral part, the conductive suspension being formed in a rectangular shape, the bridge being provided only on the long side thereof.

In some embodiments, the conductive suspension includes an outer peripheral part seated on the frame, an inner peripheral part spaced apart from the outer peripheral part, with the voice coil attached thereto, and a bridge for connecting the outer peripheral part to the inner peripheral part, the conductive suspension being formed in a rectangular shape, the bridge being provided on both the long side and the short side thereof.

In some embodiments, the acoustic system is formed in a rectangular shape, and the sub-diaphragm is attached only to the short side of the acoustic system.

In some embodiments, the acoustic system is formed in a rectangular shape, and the sub-diaphragm is attached to both the long side and the short side of the acoustic system.

In some embodiments, the conductive suspension includes an outer peripheral part seated on the frame, an inner peripheral part spaced apart from the outer peripheral part, with the voice coil attached thereto, and a bridge for connecting the outer peripheral part to the inner peripheral part, the conductive suspension being formed in a rectangular shape, the bridge connecting the short side of the inner peripheral part to the long side of the outer peripheral part.

In some embodiments, the conductive suspension includes an outer peripheral part seated on the frame, an inner peripheral part spaced apart from the outer peripheral part, with the voice coil attached thereto, and a bridge for connecting the outer peripheral part to the inner peripheral part, the conductive suspension being formed in a rectangular shape, the bridge connecting the long side of the inner peripheral part to the short side of the outer peripheral part.

In some embodiments, the acoustic system is formed in a rectangular shape, and the sub-diaphragm extends as long as the entire length of the short side of the acoustic system and then extends from both ends of the short side to the long sides by a certain length.

In some embodiments, the conductive suspension includes an outer peripheral part seated on the frame, an inner peripheral part spaced apart from the outer peripheral part, with the voice coil attached thereto, and a bridge for connecting the outer peripheral part to the inner peripheral part, the short side of the inner peripheral part and some portion of the long side to which the sub-diaphragm is attached have a larger width than the other portion of the long side to which the sub-diaphragm is not attached.

In some embodiments, the sub-diaphragm is formed in a dome shape with a protruding center portion in the width, and the width of the dome is constant over the entire length.

In some embodiments, the high power microspeaker further includes an additional sub-diaphragm attached to the long side.

The high power microspeaker with the sub-diaphragm provided by the present invention can be provided with the split-type sub-diaphragm to facilitate the air inflow between the main diaphragm and the sub-diaphragm, such that the smooth inner air flow emits heat in high power application, which suppresses deformation of the diaphragm and improves THD characteristics.

In addition, the high power microspeaker with the sub-diaphragm provided by the present invention can compensate for differences in diaphragm rigidity between the long sides and the short sides of the rectangular microspeaker structure to improve vibration balance.

Those skilled in the art will recognize additional features and advantages upon reading the following detailed description, and upon viewing the accompanying drawings.

BRIEF DESCRIPTION OF THE DRAWINGS

The elements of the drawings are not necessarily to scale relative to each other. Like reference numerals designate corresponding similar parts. The features of the various illustrated embodiments can be combined unless they exclude each other. Embodiments are depicted in the drawings and are detailed in the description which follows.

DETAILED DESCRIPTION

Hereinafter, preferred embodiments of a high power microspeaker with a sub-diaphragm according to the present invention will be described in detail with reference to the accompanying drawings.

The present invention provides a structure in which an acoustic system including a main diaphragm and a conductive suspension of a microspeaker is attached to a top end surface of a coil and a separate sub-diaphragm is attached to the same surface of the coil.

In addition, the present invention provides a structure in which one main diaphragm and one conductive suspension are coupled to each other and two or more sub-diaphragms are attached to the lower portion of the conductive suspension.

The present invention also provides a structure in which a microspeaker is formed in a rectangular shape and a sub-diaphragm is attached to a short side of an acoustic system and extended to a corner portion.

Moreover, the present invention provides a structure in which a sub-diaphragm is attached to a short side of an acoustic system and a separate pair of sub-diaphragms are attached to a long side of the acoustic system.

Further, the present invention provides a structure in which a sub-diaphragm is formed to protrude in a direction opposite to a protruding direction of a main diaphragm or is formed in a flat shape without a protruding portion.

Furthermore, the present invention provides a structure in which a sub-diaphragm is attached to a conductive suspension and a top end surface of a coil is attached to the conductive suspension or the sub-diaphragm.

Still furthermore, the present invention provides a structure in which a conductive suspension is provided with two or more bridges.

According to the present invention, the sub-diaphragm aids in equalizing upper and lower amplitudes of the diaphragm, such that the microspeaker can accept higher input (power).

In addition, according to the present invention, the sub-diaphragm is attached to the top end surface of the coil, which prevents reduction of the volume of the magnetic circuit, which occurs when the sub-diaphragm is attached to the bottom end surface of the coil, as a result of which a higher electromagnetic force is obtained.

Moreover, according to the present invention, the sub-diaphragm suppresses split vibration (tilting) of the diaphragm.

Further, according to the present invention, the sub-diaphragm suppresses the increase of harmonic components of the microspeaker to reduce distortion.

Furthermore, according to the present invention, the sub-diaphragm increases the rigidity of the main diaphragm to suppress deformation of the diaphragm and reduce sound vibration.

Figure 1:
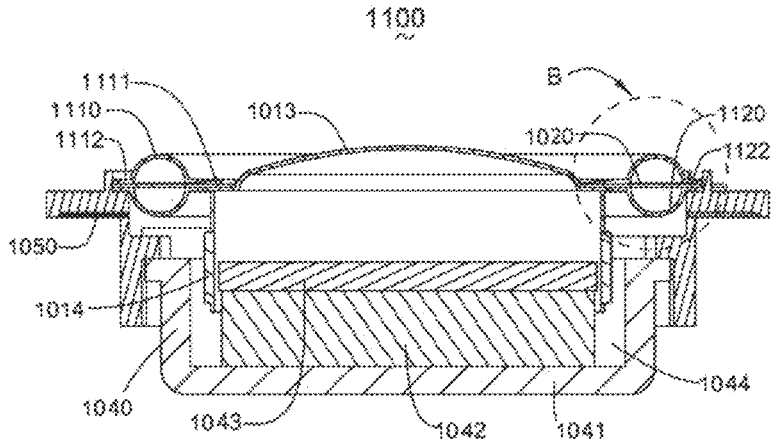
FIG. 1 is a view showing a conventional microspeaker which further includes an edge part at a lower portion of a suspension.
Figure 2:
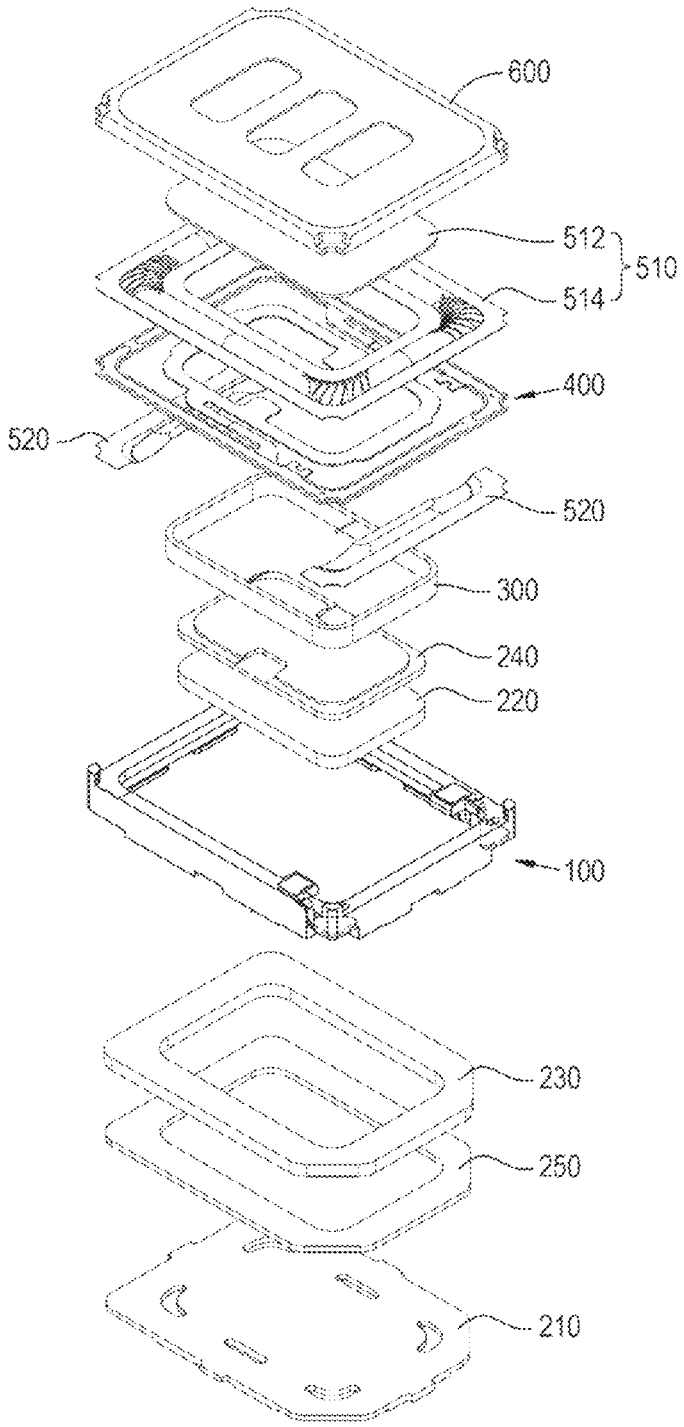
FIG. 2 is an exploded view showing a high power microspeaker with a sub-diaphragm according to a first embodiment of the present invention.
Figure 3:
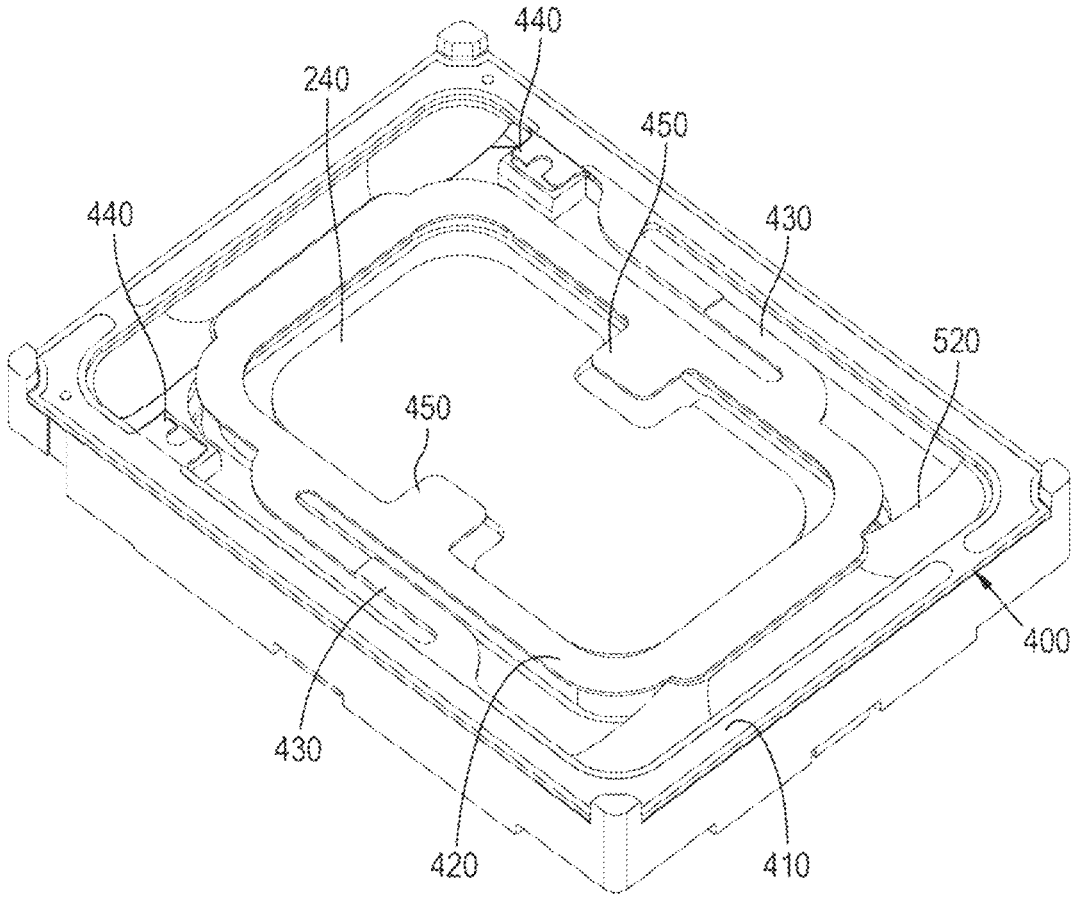
FIG. 3 is a perspective view showing the high power microspeaker with the sub-diaphragm according to the first embodiment of the present invention.
Figure 4:
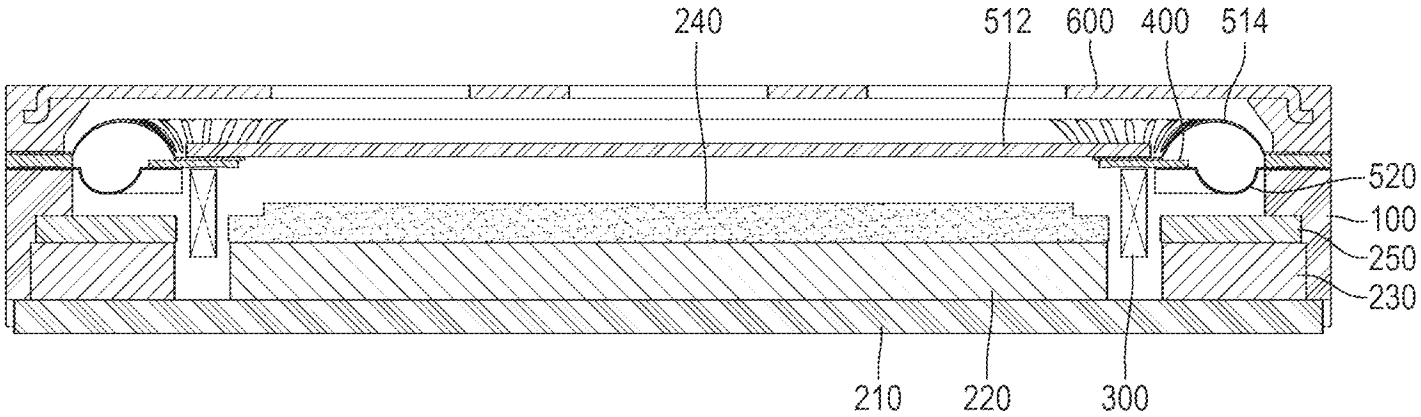
FIG. 4 is a sectional view showing the high power microspeaker with the sub-diaphragm according to the first embodiment of the present invention.

FIG. 2 is an exploded view showing a high power microspeaker with a sub-diaphragm according to a first embodiment of the present invention, FIG. 3 is a perspective view showing the high power microspeaker with the sub-diaphragm according to the first embodiment of the present invention, and FIG. 4 is a sectional view showing the high power microspeaker with the sub-diaphragm according to the first embodiment of the present invention.

In the high power microspeaker according to the first embodiment of the present invention, a magnetic circuit 210, 220, 230, 240 and 250 is installed in a frame 100, and a voice coil 300 is provided that vibrates up and down due to a mutual electromagnetic force with the magnetic circuit 210, 220, 230, 240 and 250 according to an electric signal. The magnetic circuit 210, 220, 230, 240 and 250 includes a yoke 210 coupled to the bottom end surface of the frame 100, an inner-ring magnet 220 and an outer-ring magnet 230 attached on the yoke 210, and an inner-ring top plate 240 and an outer-ring top plate 250 attached to the top surfaces of the inner-ring magnet 220 and the outer-ring magnet 230 to aid in forming a magnetic flux. The outer-ring magnet 230, which is formed in a rectangular ring shape, is disposed outside the inner-ring magnet 220, which is formed in a rectangular shape, to be spaced apart from the inner-ring magnet 220. The bottom end surface of the voice coil 300 is positioned in a magnetic gap between the inner-ring magnet 220 and the outer-ring magnet 230.

A main diaphragm 510 and a conductive suspension 400 are attached to the top end surface of the voice coil 300, the main diaphragm 510 including a center diaphragm 512 and a side diaphragm 514, the conductive suspension 400 guiding vibration of the main diaphragm 510 to suppress biased vibration and split vibration while performing an energizing function of transferring an electric signal to the voice coil 300 at the same time. Hereinafter, the main diaphragm 510 and the conductive suspension 400 are referred to as an acoustic system. In order to more suppress biased vibration and split vibration of the main diaphragm 510, a sub-diaphragm 520 is additionally attached to a lower portion of the acoustic system. The sub-diaphragm 520 is formed in a dome shape with a protruding center portion, with its inner side attached to the acoustic system and its outer side attached to the frame 100. Here, the side diaphragm 514 of the main diaphragm 510 is formed in an upwardly-protruding dome shape, while the sub-diaphragm 520 is formed in an downwardly-protruding dome shape. The high power microspeaker and the acoustic system are formed in a rectangular shape, and the sub-diaphragms 520 are attached to two points of the short sides of the acoustic system.

The conductive suspension 400 serves to guide vibration of the voice coil 300 and transfer an electric signal to the voice coil 300. To this end, the conductive suspension 400 includes a ring-shaped outer peripheral part 410 seated on the frame 100, a ring-shaped inner peripheral part 420 spaced apart from the outer peripheral part 410, and a bridge 430 for supporting the inner peripheral part 420 and allowing vertical vibration of the inner peripheral part 420. Moreover, the conductive suspension 400 includes each pair of land parts 440 and 450 extending from the outer peripheral part 410 and the inner peripheral part 420. A terminal capable of applying an external signal is electrically connected to the land part 440 extending from the outer peripheral part 410, while a lead wire of the voice coil 300 is electrically connected to the land part 450 extending from the inner peripheral part 420 by means of soldering or the like. According to the first embodiment, the bridges 430 are provided only on two points of the long sides of the conductive suspension 400 and not provided on the short sides thereof. As described above, the sub-diaphragms 520 are provided on the short sides.

Here, the inner side of the sub-diaphragm 520 and the voice coil 300 are attached to the same surface. That is, the inner side of the sub-diaphragm 520 and the top end surface of the voice coil 300 are attached to the bottom surface of the conductive suspension 400.

Figure 5:
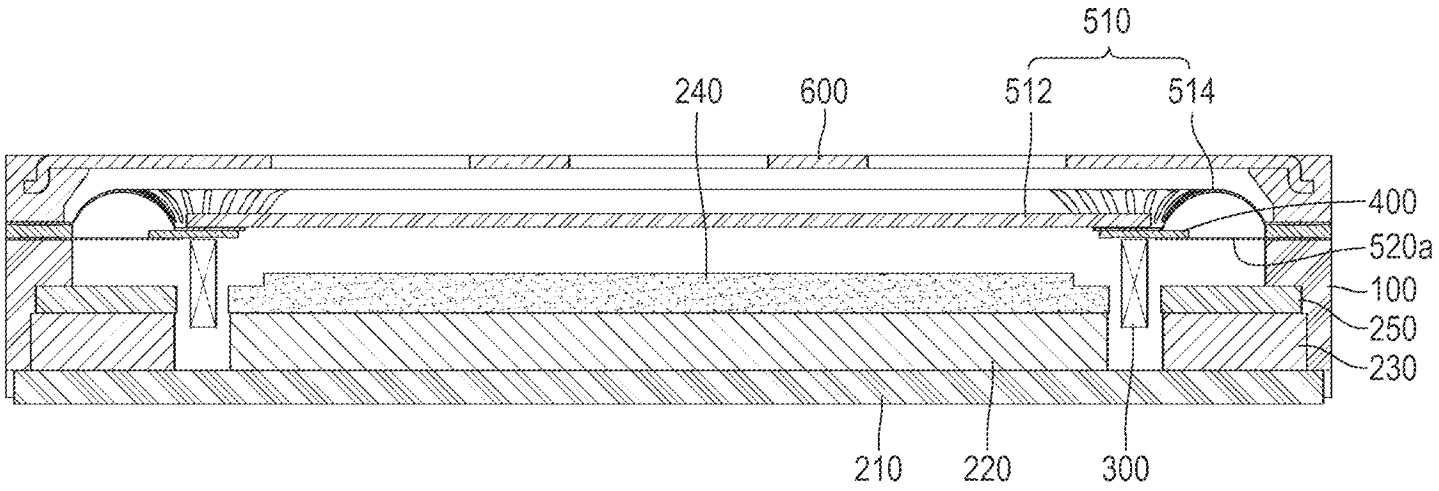
FIG. 5 is a sectional view showing a high power microspeaker with a sub-diaphragm according to a second embodiment of the present invention.

FIG. 5 is a sectional view showing a high power microspeaker with a sub-diaphragm according to a second embodiment of the present invention.

The high power microspeaker with the sub-diaphragm according to the second embodiment of the present invention is the same as that of the first embodiment except for a shape of a sub-diaphragm 520*a*. According to the second embodiment of the present invention, the sub-diaphragm 520*a* is formed in a flat shape without a protruding center portion, with its inner side attached to the acoustic system and its outer side attached to the frame 100.

Figure 6:
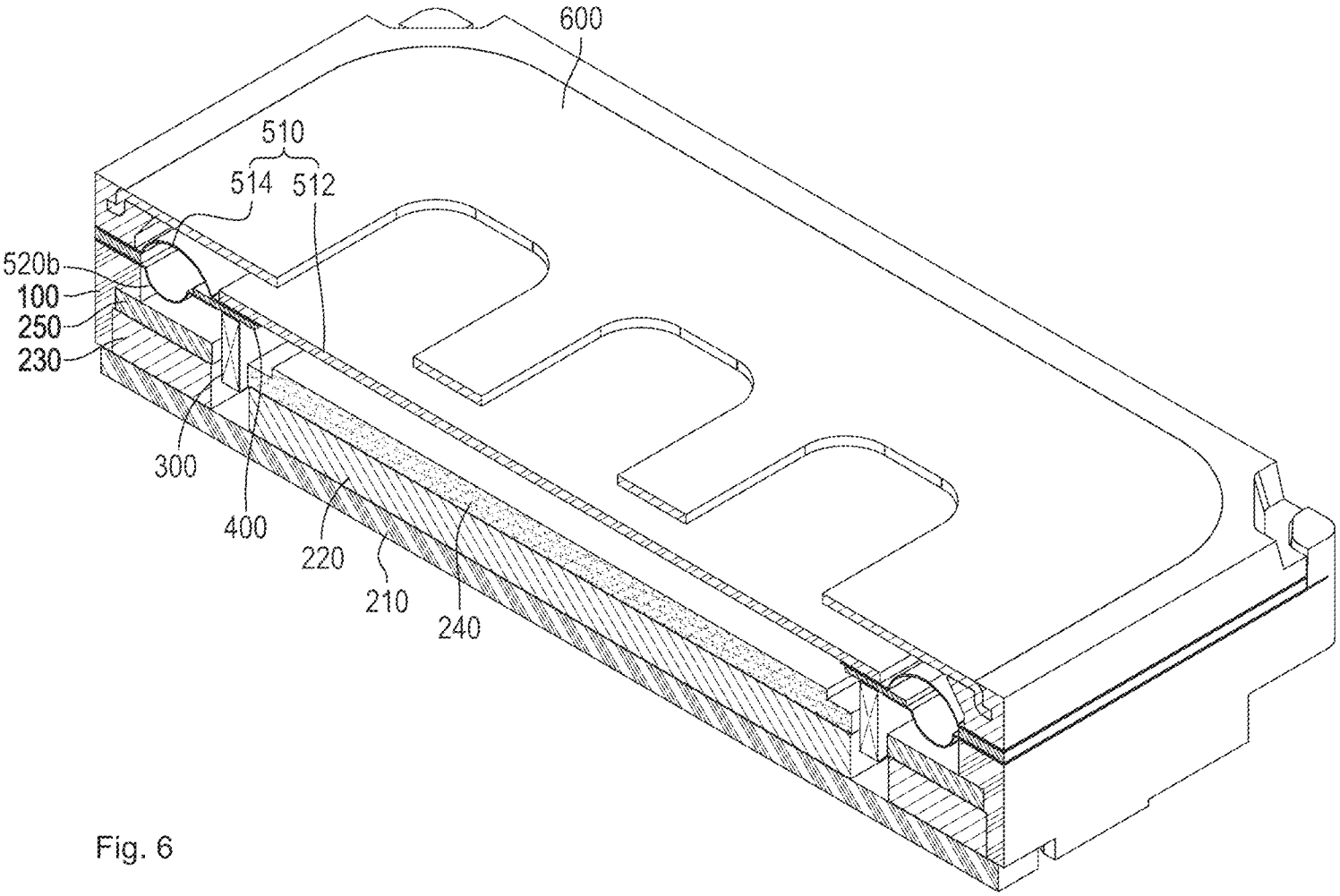
FIG. 6 is a sectional view showing a high power microspeaker with a sub-diaphragm according to a third embodiment of the present invention.

FIG. 6 is a view showing a high power microspeaker with a sub-diaphragm according to a third embodiment of the present invention.

The high power microspeaker with the sub-diaphragm according to the third embodiment of the present invention is the same as that of the first embodiment except for a shape of a sub-diaphragm 520*b* and an attachment position of the voice coil 300. According to the third embodiment of the present invention, the inner side of the sub-diaphragm 520*b* is attached to the acoustic system, and the voice coil 300 is attached to a lower portion of the sub-diaphragm 520*b*. That is, the conductive suspension 400 is attached to the bottom surface of the main diaphragm 510, the sub-diaphragm 520*b* is attached to the bottom surface of the conductive suspension 400, and the top end surface of the voice coil 300 is attached to the bottom surface of the sub-diaphragm 520*b*.

Figure 7:
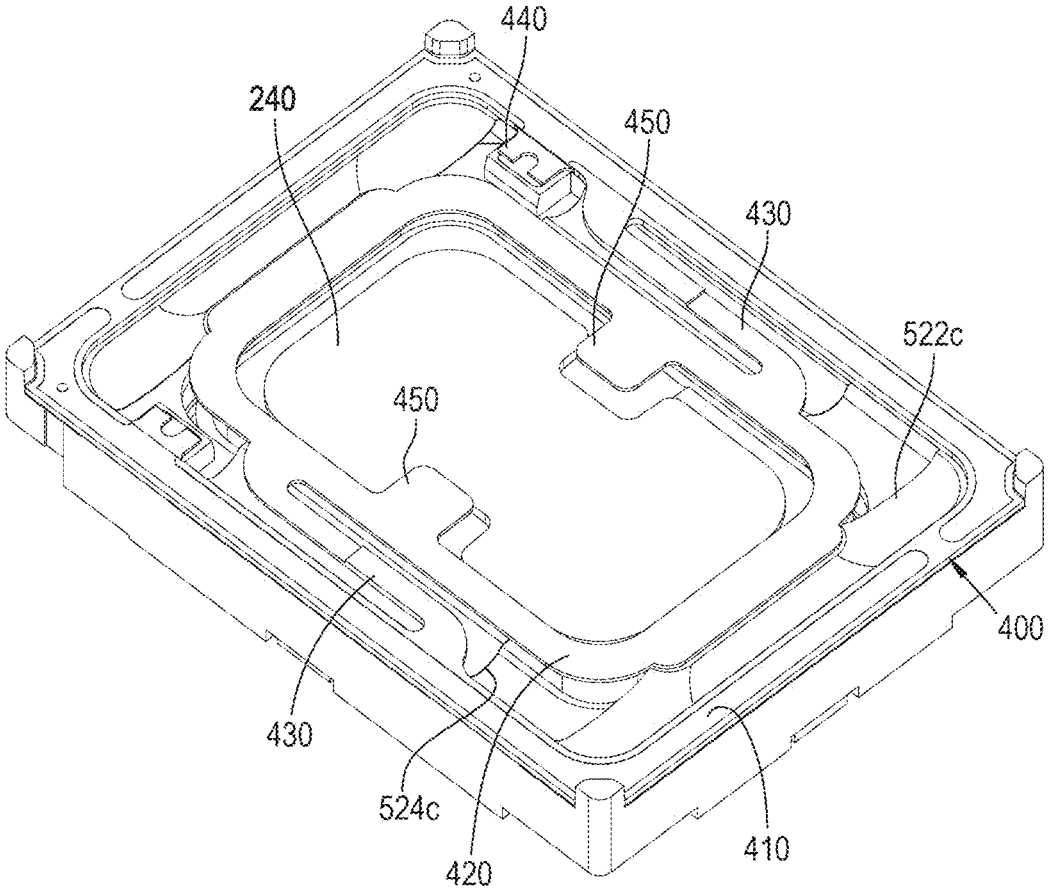
FIG. 7 is a perspective view showing a high power microspeaker with a sub-diaphragm according to a fourth embodiment of the present invention.

FIG. 7 is a view showing a high power microspeaker with a sub-diaphragm according to a fourth embodiment of the present invention. The high power microspeaker with the sub-diaphragm according to the fourth embodiment of the present invention is the same as that of the first embodiment except for a shape, attachment position and number of sub-diaphragms 522*c* and 524*c*.

According to the fourth embodiment of the present invention, the sub-diaphragms 522*c* and 524*c* are attached to a total of four points of the bottom surfaces of the short sides and the long sides of the acoustic system. Here, the bridges 430 are provided only on two points of the long sides of the conductive suspension 400.

Figure 8:
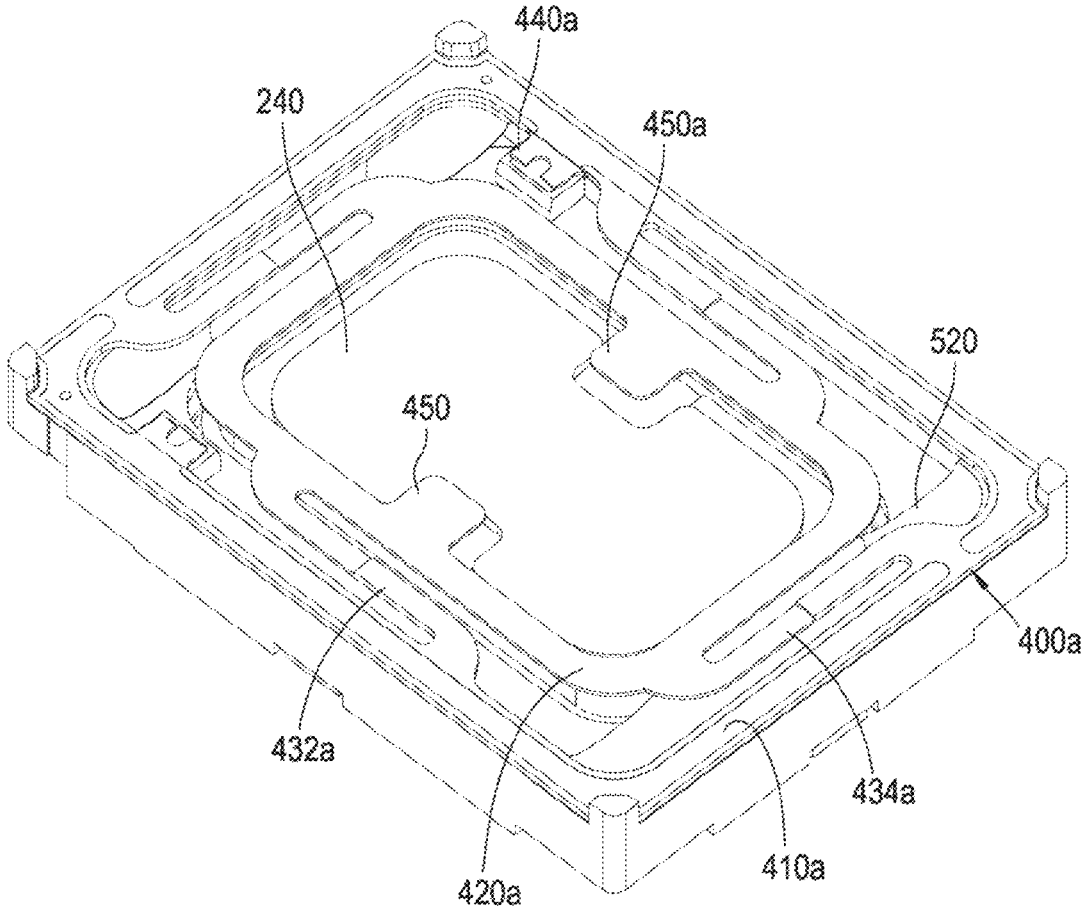
FIG. 8 is a perspective view showing a high power microspeaker with a sub-diaphragm according to a fifth embodiment of the present invention.

FIG. 8 is a view showing a high power microspeaker with a sub-diaphragm according to a fifth embodiment of the present invention. The high power microspeaker with the sub-diaphragm according to the fifth embodiment of the present invention is the same as that of the first embodiment except for a shape of a conductive suspension.

According to the fifth embodiment of the present invention, the sub-diaphragms 520 are attached only to two points of the short sides of the acoustic system, and bridges 432*a* and 434*a* are provided on a total of four points of both the long sides and the short sides of the conductive suspension 400*a*.

Figure 9:
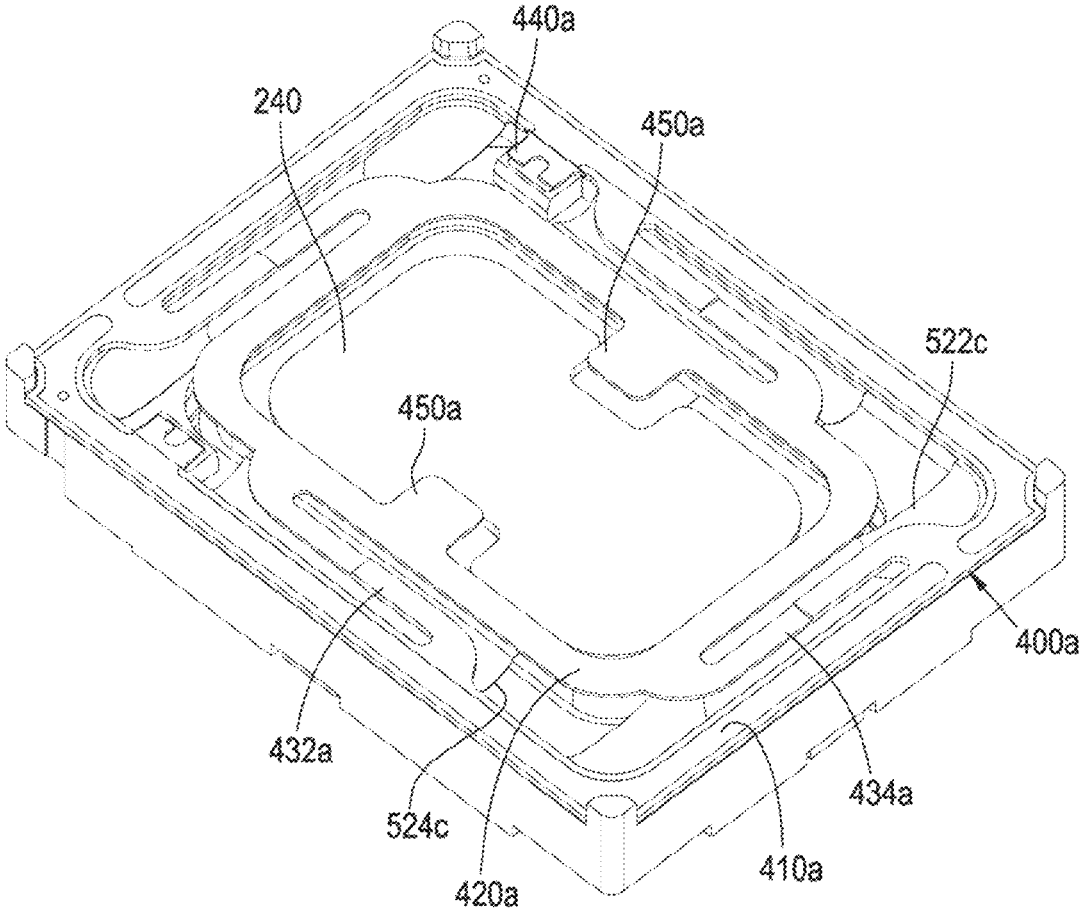
FIG. 9 is a perspective view showing a high power microspeaker with a sub-diaphragm according to a sixth embodiment of the present invention.

FIG. 9 is a view showing a high power microspeaker with a sub-diaphragm according to a sixth embodiment of the present invention. The high power microspeaker with the sub-diaphragm according to the sixth embodiment of the present invention is the same as that of the fourth embodiment except for a shape of a conductive suspension.

According to the sixth embodiment of the present invention, sub-diaphragms 522*c* and 524*c* are attached to four points of the bottom surfaces of the short sides and the long sides of the acoustic system, and bridges 432*a* and 434*a* are provided on a total of four points of both the long sides and the short sides of the conductive suspension 400*a*.

Figure 10:
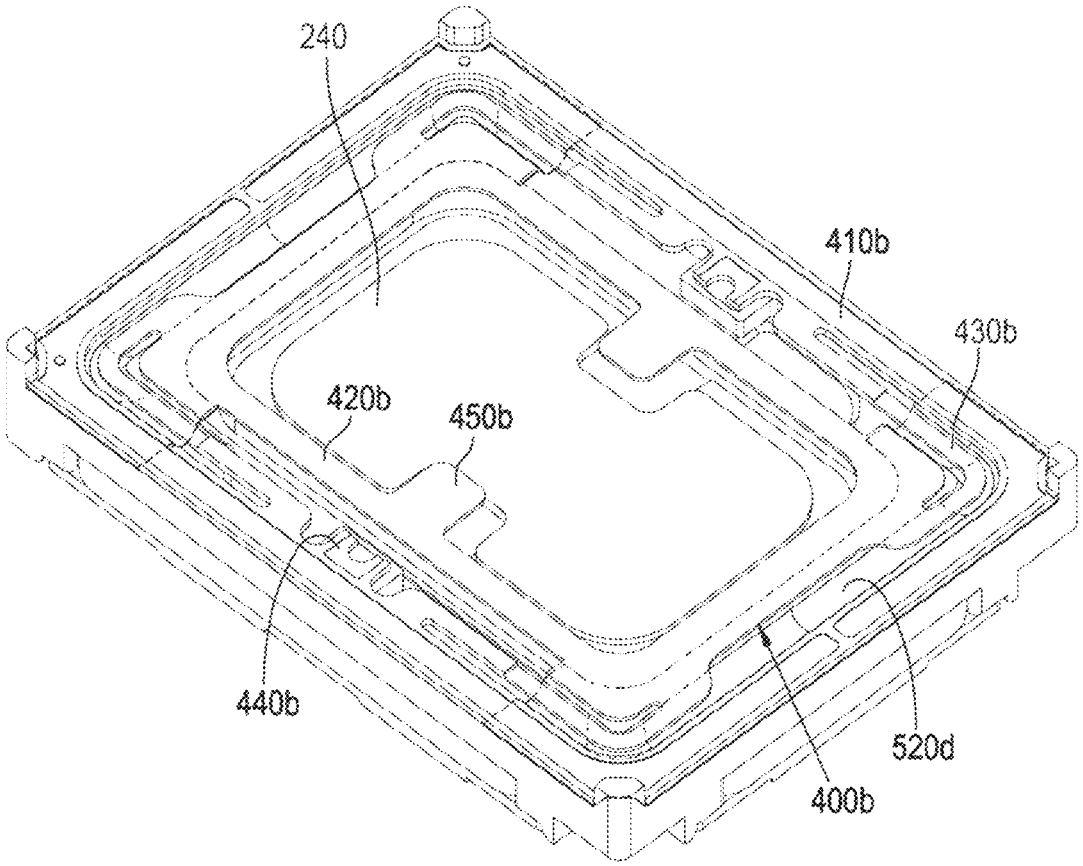
FIG. 10 is a perspective view showing a high power microspeaker with a sub-diaphragm according to a seventh embodiment of the present invention.
Figure 11:
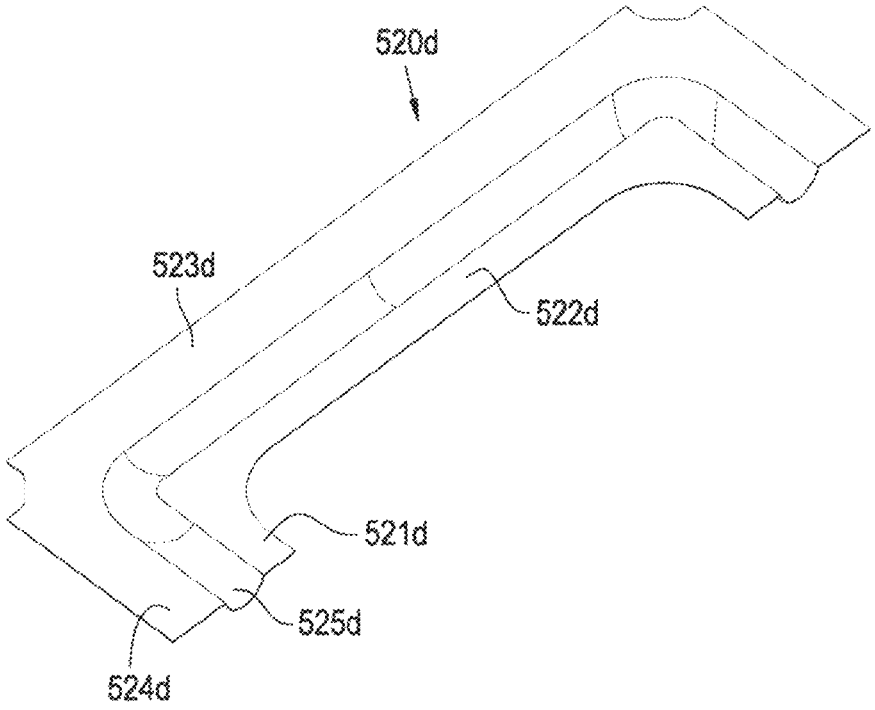
FIG. 11 is a perspective view showing the sub-diaphragm provided in the high power microspeaker according to the seventh embodiment of the present invention.

FIG. 10 is a perspective view showing a high power microspeaker with a sub-diaphragm according to a seventh embodiment of the present invention, and FIG. 11 is a perspective view showing the sub-diaphragm provided in the high power microspeaker according to the seventh embodiment of the present invention. The high power microspeaker with the sub-diaphragm according to the seventh embodiment of the present invention is the same as that of the first embodiment except for a shape of a conductive suspension and a shape of a sub-diaphragm.

A conductive suspension 400*b* includes an outer peripheral part 410*b* seated on the frame 100 (see FIG. 2), an inner peripheral part 420*b* spaced apart from the outer peripheral part 410*b*, with the voice coil 300 (see FIG. 2) attached thereto, and a bridge 430*b* for connecting the outer peripheral part 410*b* to the inner peripheral part 420*b*, the outer peripheral part 410*b* having a land part 440*b* electrically connected to a terminal capable of applying an electric signal, the inner peripheral part 420*b* having a land part 450*b* to which a lead wire of the voice coil 300 (see FIG. 2) is electrically connected by means of soldering or the like.

Here, the conductive suspension 400*b* is formed in a rectangular shape, and thus the outer peripheral part 410*b* and the inner peripheral part 420*b* are also formed in a rectangular shape, with a pair of long sides and a pair of short sides. The bridge 430*b* is formed in a shape connecting the short side of the inner peripheral part 420*b* to the long side of the outer peripheral part 410*b*.

Meanwhile, a sub-diaphragm 520*d* includes a main body 522*d* extending as long as the entire length of the short side of the acoustic system and extensions 524*d* extending from both ends of the main body 522*d* to the long sides by a certain length. That is, the sub-diaphragm 520*d* is generally formed in a shape of "[". The inner side 521*d* of the sub-diaphragm 520*d* is attached to the inner peripheral part 420*b* of the conductive suspension 400*b*, the outer side 523*d* of the sub-diaphragm 520*d* is attached to the outer peripheral part 410*b* of the conductive suspension 400*b*, and a portion of the sub-diaphragm 520*d* that is not attached to the conductive suspension 400*b* includes a protruding dome part 525*d*. In other words, when the one side extension 524*d*, the main body 522*d* and the other side extension 524*d* of the sub-diaphragm 520*d* define the length direction of the sub-diaphragm 520*d* and the inner side 521*d* and the outer side 523*d* of the sub-diaphragm 520*d* define the width direction of the sub-diaphragm 520*d*, the dome part 525*d* is provided at the center in the width direction and over the entire length in the length direction. Here, the dome part 525*d* has a constant width along the entire length, and thus has a constant width even at the corner where the main body 522*d* and the extension 524*d* meets.

Figure 12:
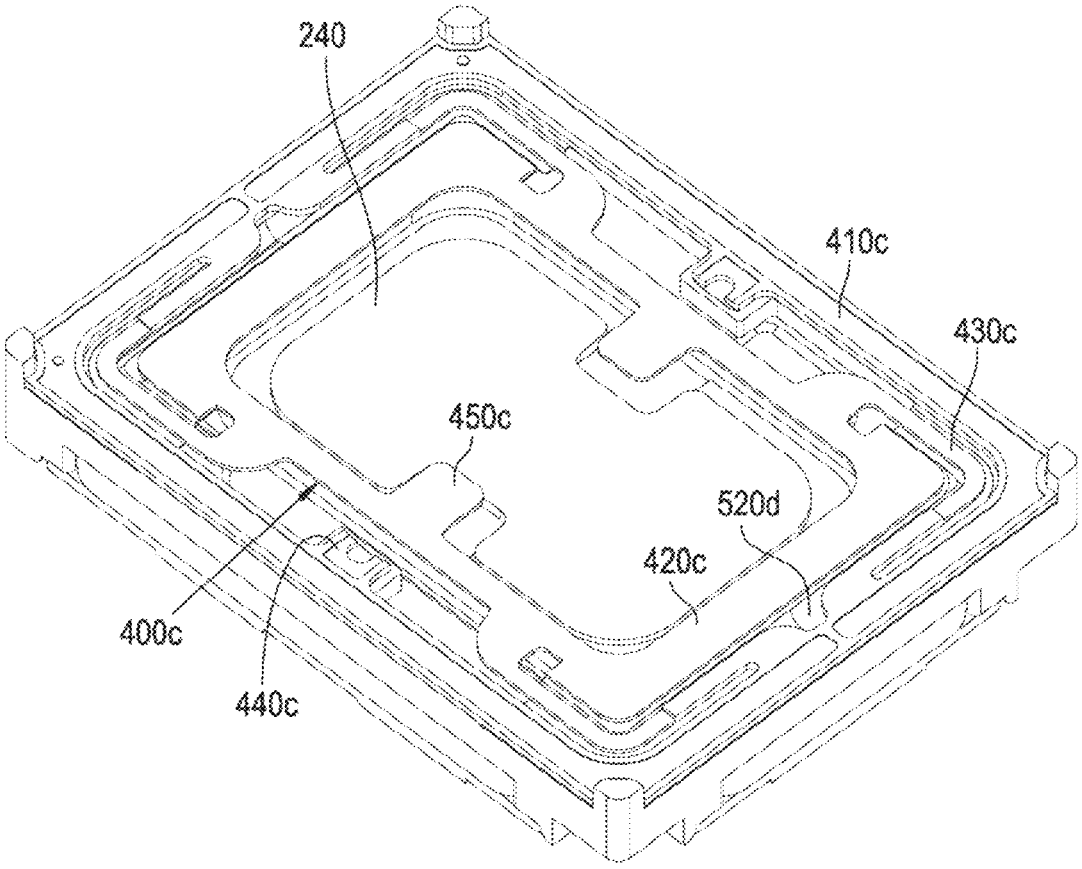
FIG. 12 is a perspective view showing a high power microspeaker with a sub-diaphragm according to an eighth embodiment of the present invention.

FIG. 12 is a perspective view showing a high power microspeaker with a sub-diaphragm according to an eighth embodiment of the present invention. The high power microspeaker with the sub-diaphragm according to the eighth embodiment of the present invention is the same as that of the seventh embodiment except for a shape of a conductive suspension.

A conductive suspension 400*c* provided in the high power microspeaker with the sub-diaphragm according to the eighth embodiment of the present invention includes an outer peripheral part 410*c* seated on the frame 100 (see FIG. 2), an inner peripheral part 420*c* spaced apart from the outer peripheral part 410*c*, the voice coil 300 (see FIG. 2) being attached thereto, and a bridge 430*c* for connecting the outer peripheral part 410*c* to the inner peripheral part 420*c*, the outer peripheral part 410*c* having a land part 440*c* electrically connected to a terminal capable of applying an electric signal, the inner peripheral part 420*c* having a land part 450*c* to which a lead wire of the voice coil 300 (see FIG. 2) is electrically connected by means of soldering or the like.

Here, the conductive suspension 400*c* is formed in a rectangular shape, and thus the outer peripheral part 410*c* and the inner peripheral part 420*c* are also formed in a rectangular shape, with a pair of long sides and a pair of short sides. The bridge 430*c* is formed in a shape connecting the short side of the inner peripheral part 420*c* to the long side of the outer peripheral part 410*c*.

Figure 13:
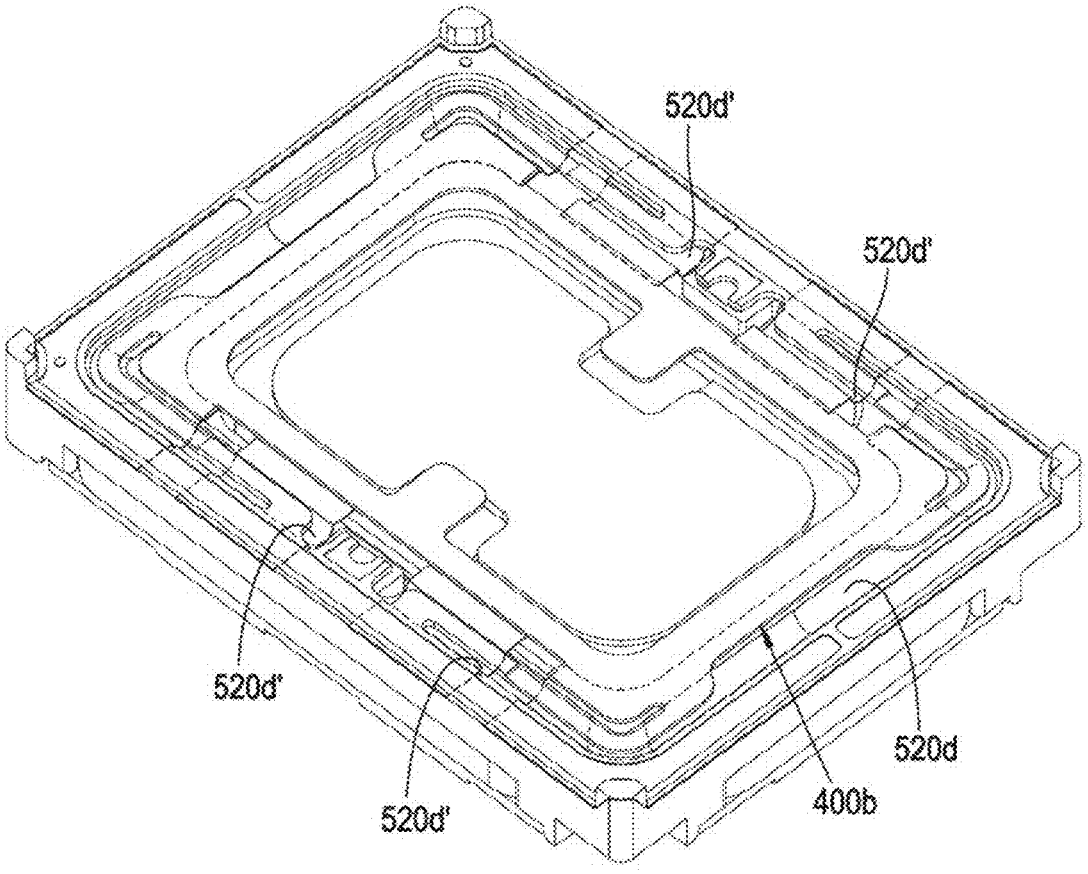
FIG. 13 is a perspective view showing a high power microspeaker with a sub-diaphragm according to a ninth embodiment of the present invention.
Figure 14:
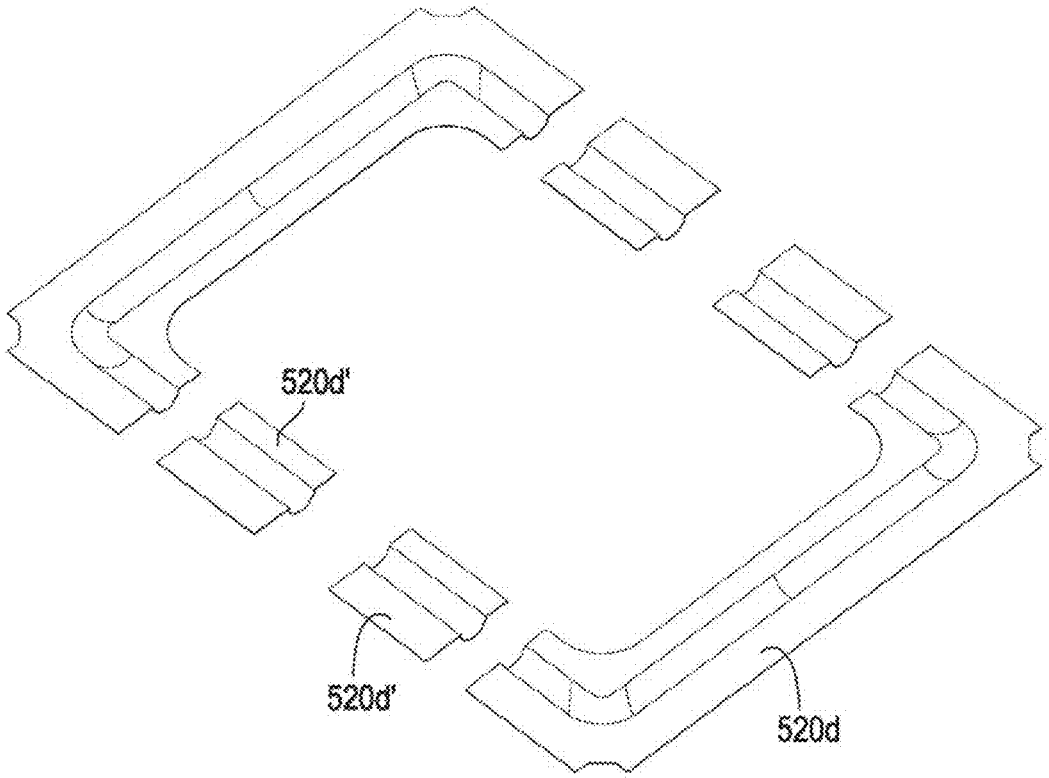
FIG. 14 is a perspective view showing the sub-diaphragm provided in the high power microspeaker according to the ninth embodiment of the present invention.

FIG. 13 is a perspective view showing a high power microspeaker with a sub-diaphragm according to a ninth embodiment of the present invention, and FIG. 14 is a perspective view showing the sub-diaphragm provided in the high power microspeaker according to the ninth embodiment of the present invention. The high power microspeaker with the sub-diaphragm according to the ninth embodiment of the present invention is the same as that of the seventh embodiment except for a structure of a sub-diaphragm.

The high power microspeaker with the sub-diaphragm according to the ninth embodiment of the present invention includes the suspension 400*b* having the same shape as that of the seventh embodiment. Likewise, the sub-diaphragm 520*d* extends as long as the entire length of the short side of the acoustic system, and then extends from both ends of the short side to the long sides by a certain length. Here, additional sub-diaphragms 520*d*' are attached to the long sides of the suspension 400*b* to which the sub-diaphragm 520*d* is not attached. The additional sub-diaphragms 520*d*' are attached to the outer peripheral part 410*b* (see FIG. 10) and the inner peripheral part 420*b* (see FIG. 10) of the long sides of the suspension 400*b*, with a protruding dome part at the center. The additional sub-diaphragms 520*d*' may be provided in an appropriate number, preferably from 2 to 6, to minimize biased vibration and split vibration of the main diaphragm 510 (see FIG. 2), while maintaining the symmetry.

Figure 15:
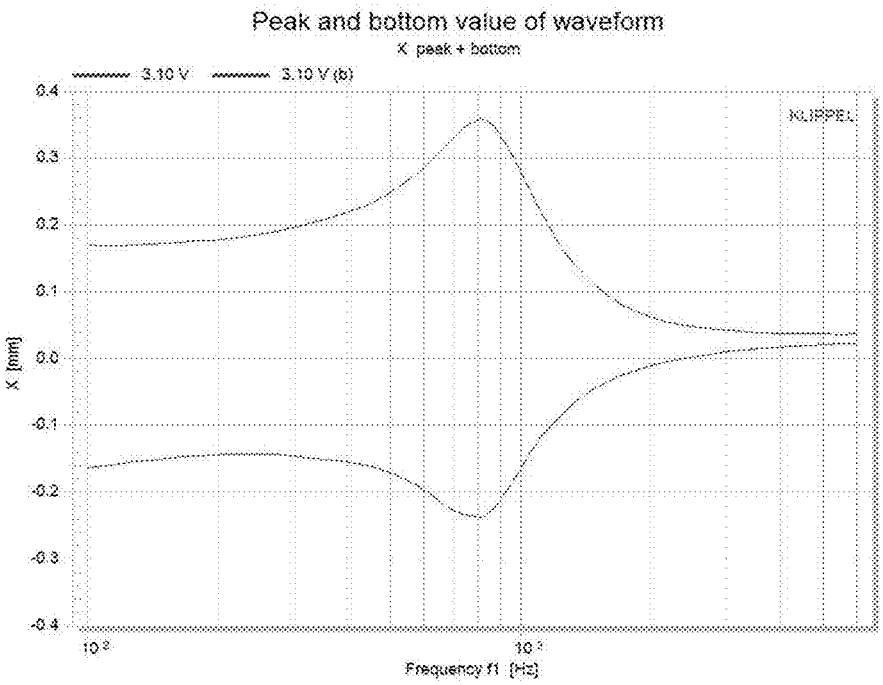
FIG. 15 is a graph showing amplitudes by frequencies of the conventional high power microspeaker without the sub-diaphragm.
Figure 16:
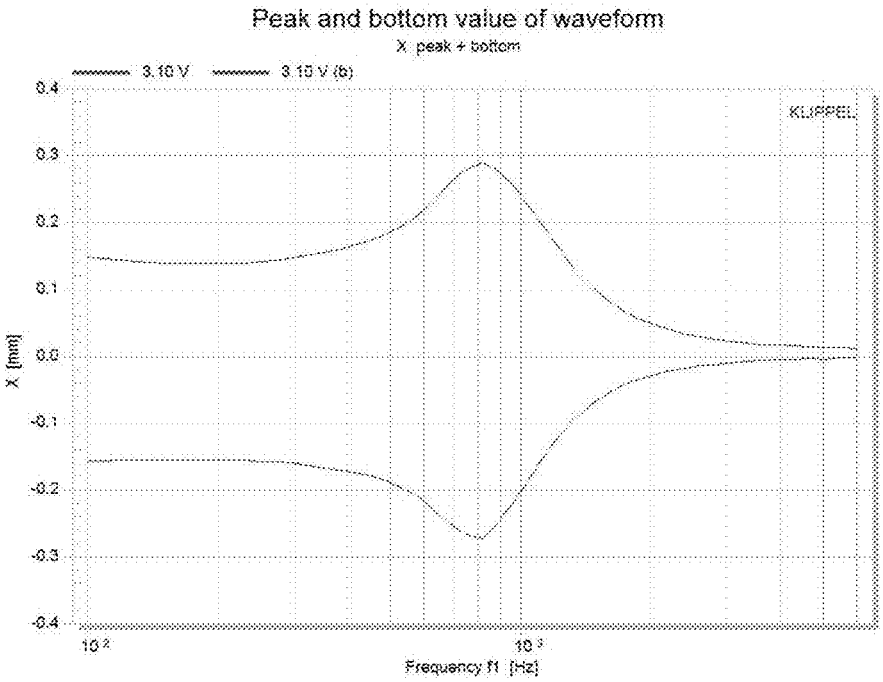
FIG. 16 is a graph showing amplitudes by frequencies of the high power microspeaker with the sub-diaphragm according to the present invention.
Figure 17:
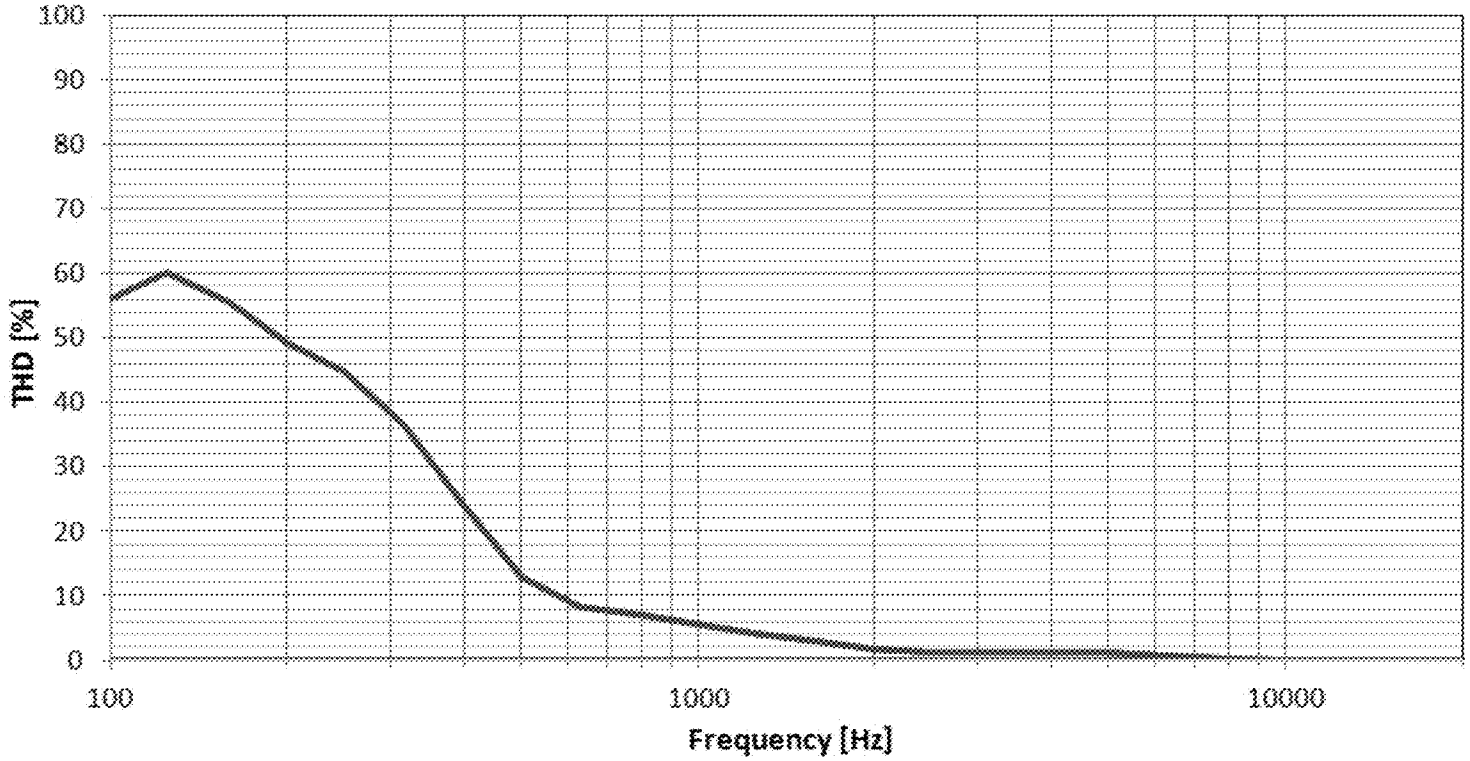
FIG. 17 is a graph showing the THD by frequencies of the conventional high power microspeaker without the sub-diaphragm.
Figure 18:
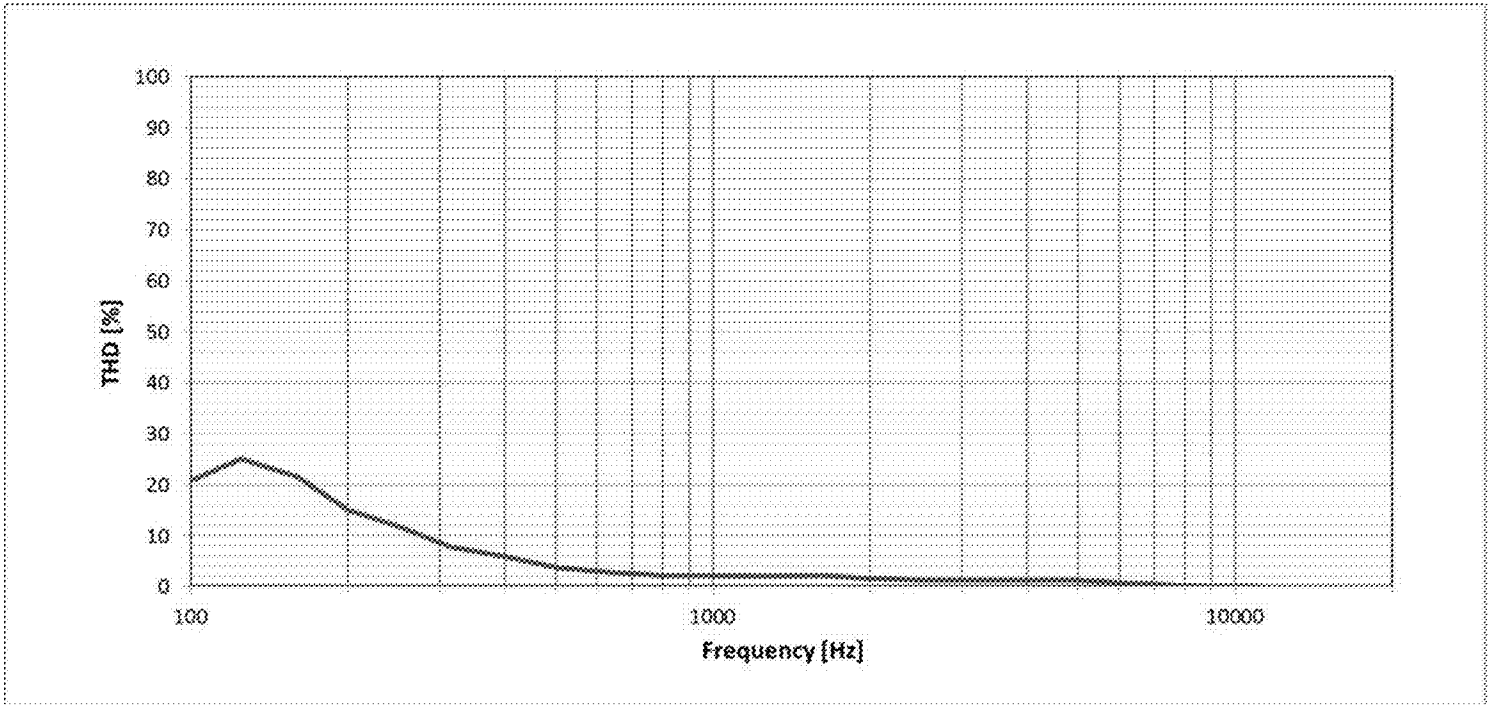
FIG. 18 is a graph showing the THD by frequencies of the high power microspeaker with the sub-diaphragm according to the present invention.

FIG. 15 is a graph showing amplitudes by frequencies of the conventional high power microspeaker without the sub-diaphragm, and FIG. 16 is a graph showing amplitudes by frequencies of the high power microspeaker with the sub-diaphragm according to the present invention. It can be seen from the graphs that the addition of the sub-diaphragm equalizes upper and lower amplitudes of the acoustic system to thereby suppress biased vibration, FIG. 17 is a graph showing the THD by frequencies of the conventional high power microspeaker without the sub-diaphragm, and FIG. 18 is a graph showing the THD by frequencies of the high power microspeaker with the sub-diaphragm according to the present invention. It can be seen that the addition of the sub-diaphragm suppresses the increase of harmonic components to thereby considerably reduce the THD.

As discussed earlier, as compared with the conventional high power microspeaker in which the sub-diaphragm is formed in a ring shape and thus forms an air pocket when attached to the main diaphragm, the high power microspeaker with the sub-diaphragm according to the present invention can be provided with the split-type sub-diaphragm to facilitate the air inflow between the main diaphragm and the sub-diaphragm, such that the smooth inner air flow emits heat in high power application, which suppresses deformation of the diaphragm and improves THD characteristics. The conventional structure is not suitable for the high power speaker, since heat is raised in the diaphragm due to the air pocket, and increases the whole rigidity of the vibration system, which leads to reduction of the SPL. Also, the conventional structure causes deformation of the diaphragm in vibration since the air inflow is not smooth between the main diaphragm and the sub-diaphragm.

On the contrary, in the high power microspeaker with the sub-diaphragm according to the present invention, the sub-diaphragms are split and attached to two or four points, such that the air inflow is facilitated between the main diaphragm and the sub-diaphragm, which makes it easier to emit heat. It is thus possible to suppress deformation of the diaphragm and improve THD characteristics.

Furthermore, the high power microspeaker with the sub-diaphragm according to the present invention can compensate for differences in diaphragm rigidity between the long sides and the short sides of the rectangular microspeaker structure to improve vibration balance, by appropriately adjusting the formation positions of the bridges of the conductive suspension and the attachment positions of the sub-diaphragms.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A high power microspeaker, comprising:

a frame;

a magnetic circuit installed in the frame;

a voice coil having a bottom end positioned in a magnetic gap of the magnetic circuit;

an acoustic system including a main diaphragm which has a center diaphragm and a side diaphragm, vibrated by the voice coil to emit sound, and a conductive suspension for guiding vibration of the main diaphragm and transferring an electric signal to the voice coil; and a plurality of sub-diaphragms attached in a split-type arrangement in a peripheral direction of the acoustic system to an outside of an attachment position of the voice coil, at least one of the plurality of sub-diaphragms having an inner side attached to a bottom surface of the acoustic system and an outer side attached to the frame, to guide vibration of the main diaphragm.

2. The high power microspeaker of claim 1, wherein the at least one of the plurality of sub-diaphragms is formed in a dome shape with a protruding center portion.

3. The high power microspeaker of claim 1, wherein the at least one of the plurality of sub-diaphragms is formed in a flat shape without a protruding portion.

4. The high power microspeaker of claim 1, wherein the at least one of the plurality of sub-diaphragms is attached to the bottom surface of the acoustic system, and wherein the voice coil is attached to a bottom surface of the at least one of the plurality of sub-diaphragms.

5. The high power microspeaker of claim 1, wherein the conductive suspension comprises an outer peripheral part seated on the frame, an inner peripheral part spaced apart from the outer peripheral part, with the voice coil attached thereto, and a bridge for connecting the outer peripheral part to the inner peripheral part, wherein the conductive suspension is formed in a rectangular shape, wherein the bridge is provided only on a long side thereof, and wherein the inner side of the at least one of the plurality of sub-diaphragms is attached to a bottom surface of the inner peripheral part and the outer side of the at least one of the plurality of sub-diaphragms is attached between a bottom surface of the outer peripheral part and the frame.

6. The high power microspeaker of claim 1, wherein the conductive suspension comprises an outer peripheral part seated on the frame, an inner peripheral part spaced apart from the outer peripheral part, with the voice coil attached thereto, and a bridge for connecting the outer peripheral part to the inner peripheral part, wherein the conductive suspension is formed in a rectangular shape, wherein the bridge is provided on both a long side and a short side thereof, and wherein the inner side of the at least one of the plurality of sub-diaphragms is attached to a bottom surface of the inner peripheral part and the outer side of the at least one of the plurality of sub-diaphragms is attached between a bottom surface of the outer peripheral part and the frame.

7. The high power microspeaker of claim 1, wherein the acoustic system is formed in a rectangular shape, and wherein the at least one of the plurality of sub-diaphragms is attached only to a short side of the acoustic system.

8. The high power microspeaker of claim 1, wherein the acoustic system is formed in a rectangular shape, and wherein the at least one of the plurality of sub-diaphragms is attached to both a long side and a short side of the acoustic system.

9. The high power microspeaker of claim 1, wherein the conductive suspension comprises an outer peripheral part seated on the frame, an inner peripheral part spaced apart from the outer peripheral part, with the voice coil attached thereto, and a bridge for connecting the outer peripheral part to the inner peripheral part, wherein the conductive suspension is formed in a rectangular shape, wherein the bridge connects a short side of the inner peripheral part to a long side of the outer peripheral part, and wherein the inner side of the at least one of the plurality of sub-diaphragms is attached to a bottom surface of the inner peripheral part and the outer side of the at least one of the plurality of sub-diaphragms is attached between a bottom surface of the outer peripheral part and the frame.

10. The high power microspeaker of claim 1, wherein the conductive suspension comprises an outer peripheral part seated on the frame, an inner peripheral part spaced apart from the outer peripheral part, with the voice coil attached thereto, and a bridge for connecting the outer peripheral part to the inner peripheral part, wherein the conductive suspension is formed in a rectangular shape, wherein the bridge connects a long side of the inner peripheral part to a short side of the outer peripheral part, and wherein the inner side of the at least one of the plurality of sub-diaphragms is attached to a bottom surface of the inner peripheral part and the outer side of the at least one of the plurality of sub-diaphragms is attached between a bottom surface of the outer peripheral part and the frame.

11. The high power microspeaker of claim 1, wherein the acoustic system is formed in a rectangular shape, and wherein the at least one of the plurality of sub-diaphragms extends as long as an entire length of a short side of the acoustic system and then extends from both ends of the short side of the acoustic system to a long side of the acoustic system by a certain length.

12. The high power microspeaker of claim 11, wherein the conductive suspension comprises an outer peripheral part seated on the frame, an inner peripheral part spaced apart from the outer peripheral part, with the voice coil attached thereto, and a bridge for connecting the outer peripheral part to the inner peripheral part, wherein the inner side of the at least one of the plurality of sub-diaphragms is attached to a bottom surface of the inner peripheral part and the outer side of the at least one of the plurality of sub-diaphragms is attached between a bottom surface of the outer peripheral part and the frame, and wherein a short side of the inner peripheral part and a portion of a long side of the inner peripheral part to which the at least one of the plurality of sub-diaphragms is attached have a larger width than a portion of a long side of the inner peripheral part to which the at least one of the plurality of sub-diaphragms is not attached.

13. The high power microspeaker of claim 11, wherein the at least one of the plurality of sub-diaphragms is formed in a dome shape with a protruding center portion in the width, and wherein the width of the dome is constant over the entire length.

14. The high power microspeaker of claim 11, further comprising an additional sub-diaphragm attached to the long side of the acoustic system.

* * * * *